US005379973A

United States Patent [19]

Rader

[11] Patent Number: 5,379,973

[45] Date of Patent: Jan. 10, 1995

[54] DESKTOP CONSOLE WITH ARMRESTS FOR SPLIT KEYPAD USAGE, AND A TILTABLE WORK CENTER IN BETWEEN

[76] Inventor: Thomas F. Rader, 38 Grant Ave., Manitou Springs, Colo. 80829

[21] Appl. No.: 36,526

[22] Filed: Mar. 24, 1993

[51] Int. Cl.[6] ..... B43L 15/00

[52] U.S. Cl. ..... 248/118.1; 248/441.1; 248/918

[58] Field of Search ..... 248/118, 118.1, 118.3, 248/118.5, 918, 345.1, 441.1; 400/715, 714, 713; 301/222

[56] References Cited

U.S. PATENT DOCUMENTS

| | | | |
|---|---|---|---|
| 4,635,893 | 1/1987 | Nelson | 248/918 X |
| 5,122,786 | 6/1992 | Rader . | |
| 5,147,090 | 9/1992 | Mandell et al. | 248/118.1 |
| 5,201,485 | 4/1993 | Moss et al. | 248/118 |
| 5,240,210 | 8/1993 | Honto, Jr. et al. | 248/118.1 |

*Primary Examiner*—Blair M. Johnson

*Attorney, Agent, or Firm*—Phillip A. Rein

[57] ABSTRACT

Desktop console accessory unit is designed to sit atop a desk to accommodate the use of split keypads and provide a comfortable work environment which permits a user to perform any and all writing, reading, drawing, inputting, and computer operations from a common central position. The elevated inverted "V" shaped base supports a diagonally positioned adjustable tiltable work surface in the middle. Each wing of the "V" shaped base provides elevated armrests to ensure proper arm/wrist/hand alignment and support for split keypad use. An accessory compartment is diagonally positioned and centered between the wings of the platform base for storing miscellaneous materials and electronic equipment, and to provide space for positioning of switches and displays on the top and/or front surfaces for controlling peripheral equipment and displaying operating conditions. Unit facilitates optimum comfort, convenience, posture, ergonomics, and accessibility conducive to functional workstation design.

14 Claims, 1 Drawing Sheet

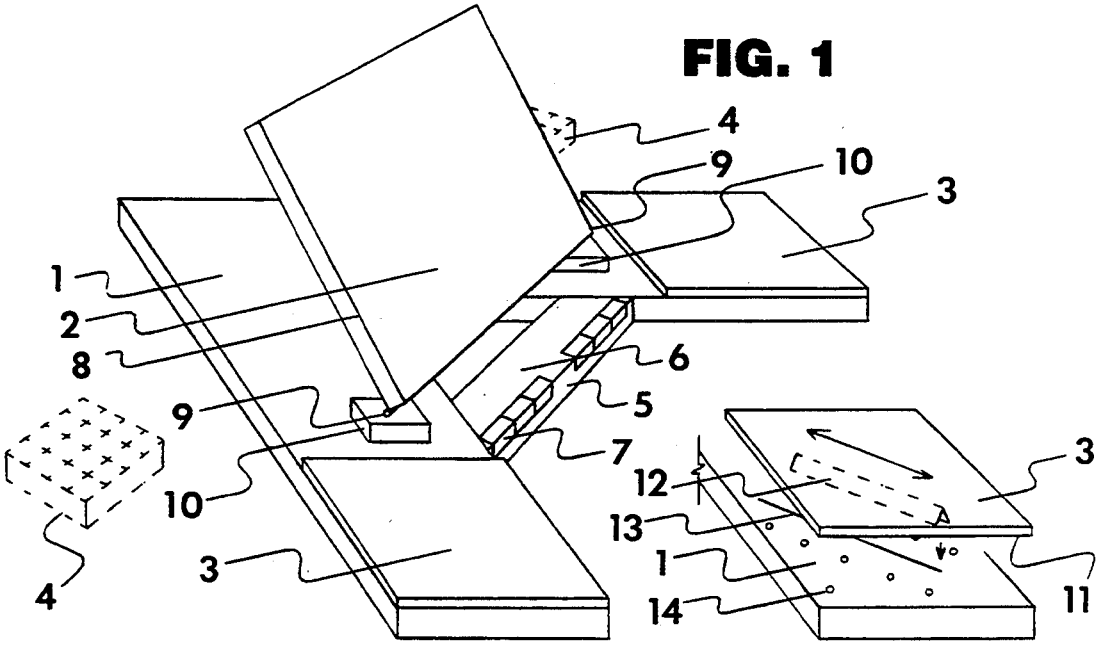
FIG. 1
FIG. 2
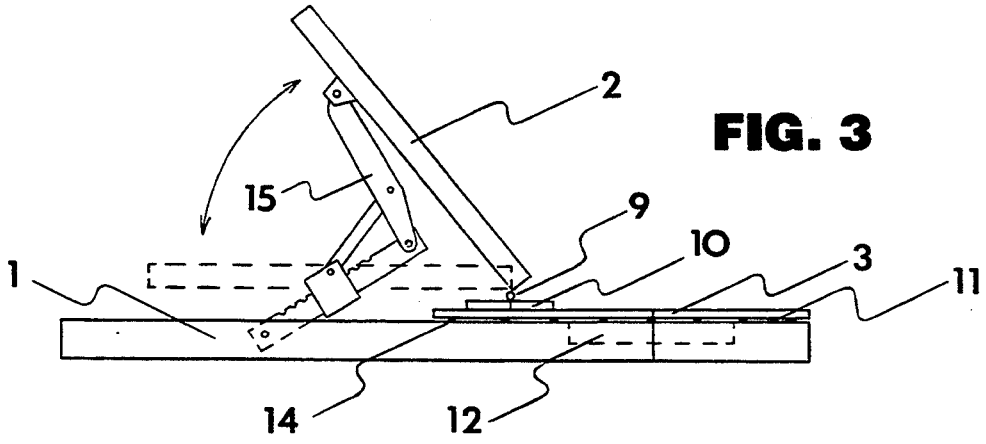
FIG. 3

DESKTOP CONSOLE WITH ARMRESTS FOR SPLIT KEYPAD USAGE, AND A TILTABLE WORK CENTER IN BETWEEN

BACKGROUND AND SUMMARY OF THE INVENTION

This invention relates generally to workstation design and the use of split keypads for computer operation. This desktop console accessory unit is designed to sit atop an existing desk to accommodate the use of split keypads and provide an adjustable and versatile center work space which permits a user to perform any and all writing, reading, drawing, inputting, and computer operations from a common central position.

Most prior art workstations have been designed to accommodate writing, reading, and drawing functions on one portion of the desktop surface area, and accommodate computer operations on another. This practice was dictated by prior art technology wherein one central position (common to performing all functions) was not available because of the predominant use of the conventional unitary one piece keyboard which occupies the work space in front of the user and prevents other uses therein. The lack of an integrated and multi-function work space, along with the lack of suitable related products, has resulted in an inability to design workstations which offer optimum comfort, convenience, ergonomics, functionality, and user friendliness. While split keyboards have been developed in prior art, there has been inadequate companion products which provide support for the arms and allow the keypads to work to their optimum benefit. While adjustable work surfaces have been developed in prior art, they have been designed primarily as drawing boards, and have not been designed as all around workstation platforms; nor have they been tailored to computer operations; nor have they been designed to provide arm supports for split keypads. No known device exists which combines all these elements; nor is designed for total multi-function and integrated applications; nor provides the optimum ergonomics required to prevent or minimize repetitive stress injuries which result from extensive use of conventional keyboards.

It is therefore a principle object of the present invention to provide a desktop console accessory unit which combines and integrates various elements in a functional manner, and provides a platform around which optimum workstations can be designed. A further object of the present invention is to provide a centrally located adjustable tiltable work surface which accommodates all desktop functions. A further object of the present invention is to provide armrests for supporting and aligning arms, wrists, and hands in proper position, both horizontally and vertically, for operating individual keypads on either side of the centrally located adjustable work surface. A further object of the present invention is to provide armrest pads which move slightly forward and backward to facilitate similar movement required for ergonomically correct keyboard/keypad operation. A further object of the present invention is to provide a built-in compartment within the desktop console which permits storing objects and for handling auxiliary electrical components.

These and other objects are accomplished in accordance with the illustrated preferred embodiment of the present invention by providing a complete desktop console accessory unit which combines and integrates the following elements: (1) an inverted "V" shaped base which provides an elevated platform for all other elements, (2) an adjustable tiltable work surface board centrally and diagonally positioned upon the platform, (3) padded armrests positioned on the left and right wings of the platform base, and (4) a centrally and diagonally positioned accessory compartment located between each wing of the platform. Accordingly, the user can perform all desktop related writing, reading, drawing, inputting, and computing functions from a common centrally located position which facilitates optimum comfort, convenience, functionality, ergonomics, and user friendliness.

BRIEF DESCRIPTION OF THE DRAWINGS

FIG. 1 is a pictorial representation of the complete desktop console accessory unit constructed in accordance with the present invention illustrating its use as situated in the inward corner atop a typical corner desk, and in relationship with typical individual split keypads (the latter not being a part of this invention).

FIG. 2 is a pictorial representation of the left wing of the desktop unit illustrating the optional forward/backward moving arm rest pad. (FIG. 2 is representative of both left and right wing applications with the right wing application being a mirror image of FIG. 2.)

FIG. 3 is a side elevation of the complete desktop accessory unit illustrating the tiltable work surface in relationship to adjustment means and the platform base

DETAILED DESCRIPTION OF THE INVENTION

Referring now to FIG. 1, the complete desktop console accessory unit is comprised of an inverted "V" shaped platform base 1 upon which an adjustable tiltable polygonal or rectangular work surface board 2 is centrally and diagonally positioned, and upon which padding 3 is provided atop the extremities of the left and right wings of platform base 1 to serve as armrests to support and align the respective arms, wrists, and hands of the user for use with a variety of available existing split keypads 4 used primarily for computer operations. This desktop console accessory unit is also comprised of a centrally and diagonally positioned compartment 5 between the wings of the platform base which accepts miscellaneous materials and electronic equipment, the compartment having an openable lid 6 and optional top and/or front mounted switches and displays 7 for controlling peripheral electronic equipment. This desktop console accessory unit rests atop an existing desk; with the preferred embodiment being positioned on the inward corner of a corner desk; with the monitor directly behind it. The elevation of the padding 3 and padded armrests corresponds to the elevation of the keys on the keypads 4, thus providing planar alignment for the user who sits in front of the adjustable tiltable work surface and operates the split keypads on either side. The adjustable tiltable work surface board consists of flat plate or board material with a surface of decorative laminate material on top and a subsurface laminate of ferrous sheet metal 8 to facilitate the holding and positioning of materials thereon by magnets. The adjustable tiltable work surface board 2 is affixed to the platform base 1 by hinges 9 along the front bottom edge of said board to the platform base 1 either directly or with intervening spacers 10. The intervening spacers 10 provide for proper planar alignment between the arms and the board when writing or drawing functions are required.

Referring now to FIG. 2, the padding 3 atop the respective left and right wings of the platform base 1 may optionally be mounted on rigid plate material 11 from which a downward extending fin 12, aligned in a position parallel to the sides of the adjustable tiltable rectangular work board 2, is provided for insertion of the fin into respective and correspondingly aligned elongated vertical slit 13, located in the top surface of the extremities of the left and right wings of the platform base 1, top surface also containing partially recessed ball bearing cups 14 for supporting the padded plates to allow for forward/backward motion of the padded plates and the users arms, hands, and wrists that rests upon them for ease of operating the respective keypads, the fin and slit arrangement allows for forward/backward motion of padded armrest plates to accommodate the forward/backward motion of the arms, wrists, and hands required in normal keypad operation.

Referring now to FIG. 3, the adjustable tiltable work board 2, as previously explained, is adjustably held in position by means of a variety of available and existing hardware 15 (one of which is shown) intended for that specific purpose, for which no claim of invention is intended.

The previous description of the preferred embodiments are provided to enable any person skilled in the art to make or use the present invention. Various modifications to these embodiments will be readily apparent to those skilled in the art, and the generic principles defined herein may be applied to other embodiments without the use of the inventive faculty. Thus, the present invention is not intended to be limited to the embodiments shown herein, but is to be accorded the widest scope consistent with the principles and novel features disclosed herein.

I claim:

1. A desktop console asscessory unit for workstation operation atop desks, comprising:

a "V" shaped platform base having a left wing and a right wing with top surface extremities being armrests;

a rectangular shaped work surface board having top, bottom, front, back, and side surfaces;

said work surface board tiltably attached by a front bottom edge of said work surface board to said top surface of said "V" shaped platform base;

padding on said top surface extremities of said left and right wings of said "V" shaped platform base providing said armrests being padded;

said padding on said armrests mounted on a base plate having a bottom surface of rigid plate material and a top surface of said padding, said base plates slidably attached to said top surface extremities of said left and right wings of said "V" shaped platform base to permit forward and backward movement of said base plates in a direction parallel to said side surfaces of the tiltably attached rectangular said work surface board;

adjustment means for positioning and holding the tiltably attached said work surface board in a desired position:

spacer blocks for adjustably mounting the height of the tiltably attached said work surface board to said "V" shaped platform base;

a compartment having front, back, top and bottom surfaces, said compartment positioned between said right and left wings of said "V" shaped platform base: and a plurality of ball bearing cups partially recessed in said top surface extremities to provide a bearing surface, and a respective slit in each of said top surface extremities, said slits positioned in a direction parallel to said side surfaces of the tiltably attached said work surface board to receive mounting of said base plates.

2. A desktop console accessory unit for workstation operation atop desks, comprising:

a "V" shaped platform base having a left wing and a right wing with top surface extremities being armrests;

a rectangular shaped work surface board having top, bottom, front, back, and side surfaces;

said work surface board tiltably attached by a front bottom edge of said work surface board to said top surface of said "V" shaped platform base;

padding on said top surface extremities of said left and right wings of said "V" shaped platform providing said armrests being padded;

said padding on said armrest mounted on a base plate having a bottom surface of rigid plate material and a top surface of said padding, said base plates slidably attached to said top surface extremities of said left and right wings of said "V" shaped platform base to permit forward and backward movement of said base plates in a direction parallel to said side surfaces of the tiltably attached rectangular said work surface board;

adjustment means for positioning and holding the tiltably attached said work surface board in a desired position;

spacer blocks for adjustably mounting the height of the tiltably attached said work surface board to said "V" shaped platform base;

a compartment having front, back, top, and bottom surfaces, said compartment positioned between said right and left wings of said "V" shaped platform base;

a plurality of ball bearing cups partially recessed in said top surface extremities to provide a bearing surface, and a respective slit in each of said top surface extremities, with said slits positioned in a direction parallel to said side surfaces of the tiltably attached said work surface board to receive mounting of said base plate; and said compartment further comprises a plurality of switches and displays mounted on front and top surfaces for controlling peripheral equipment and displaying operating conditions.

3. A desktop console accessory unit for workstation operation atop desks, said desktop console accessory unit comprising a "V" shaped platform base having a left wing and a right wing with top surface extremities being armrests; said platform base receiving a work surface board tiltably attached by a front bottom edge of said work surface board to said top surface of said "V" shaped platform base connecting said left wing and said right wing together.

4. The desktop console accessory unit of claim 3 wherein said armrests have padding.

5. The desktop console accessory unit of claim 3 wherein said top surface extremities of said left and right wings include a plurality of ball bearing cups partially recessed to provide a bearing surface, a respective slit in each of said top surface extremities, with said slit positioned in a direction parallel to spaced parallel side walls of the tiltably attached said work surface board to receive mounting of respective ones of said armrests in respective ones of said slits; and permit respective reciprocal movement of said armrests on said ball bearing cups.

6. The desktop console accessory unit of claim 3 wherein said armrests further comprise a plate having a bottom surface and a top surface, said top surface having padding thereon, said bottom surface having a downward fin vertically extending therefrom for insertion into respective slits in said top surface extremities of said left and right wings of said "V" shaped platform base.

7. The desktop console accessory unit of claim 3 further comprising a compartment, said compartment positioned between said right and left wings of said "V" shaped platform base; and said compartment further comprising a plurality of switches and displays mounted on front and top surfaces for controlling peripheral equipment and displaying operating conditions.

8. A desktop console accessory unit for workstation operation with a split keyboard atop desks being especially adapted for use atop a corner desk, comprising:

a V-shaped platform base with outer extremities of a left wing and right wing being armrests; and a work surface board mounted on said V-shaped platform base and inclined upwardly therefrom.

9. A desktop console accessory unit as described in claim 8, including:

a compartment mounted between said right and left wings having control elements therein operable to control peripheral equipment and displaying operating conditions.

10. A desktop console accessory unit as described in claim 8, wherein:

said work surface board having a layer of ferrous metal for holding and positioning of work materials thereon by use of magnet members.

11. A desktop console accessory unit as described in claim 8, wherein:

said left and right wings each having padding thereon on outer extremities to comfortably receive the arms of the user therein.

12. A desktop console accessory unit as described in claim 8, wherein:

said armrests are mounted on respective ball bearing cups so as to be movable relative to said V-shaped platform base and said work surface board.

13. A desktop console accessory unit as described in claim 8, wherein:

said armrests are movably mounted on said V-shaped platform base for comfort of a user thereof.

14. A desktop console accessory unit as described in claim 8, wherein:

said armrests are movable in parallel planes relative to opposed vertical side walls of said work surface board.

* * * * *